United States Patent [19]

Fuller

[11] Patent Number: 4,513,668

[45] Date of Patent: Apr. 30, 1985

[54] WEAR REDUCING PROJECTILE

[75] Inventor: Peter W. W. Fuller, Bromley, England

[73] Assignee: The Secretary of State for Defence in Her Britannic Majesty's Government of the United Kingdom of Great Britain and Northern Ireland, London, England

[21] Appl. No.: 499,761

[22] PCT Filed: Aug. 4, 1982

[86] PCT No.: PCT/GB82/00242

§ 371 Date: Apr. 18, 1983

§ 102(e) Date: Apr. 18, 1983

[87] PCT Pub. No.: WO83/00737

PCT Pub. Date: Mar. 3, 1983

[30] Foreign Application Priority Data

Aug. 18, 1981 [GB] United Kingdom ..... 8125239

[51] Int. Cl.[3] ..... F42B 11/20

[52] U.S. Cl. ..... 102/511

[58] Field of Search ..... 102/501, 511, 512, 367, 102/370, 430, 443; 89/7

[56] References Cited

U.S. PATENT DOCUMENTS

| | | | |
|---|---|---|---|
| 2,444,283 | 6/1948 | Detrich | 102/370 |
| 3,208,387 | 9/1965 | Giles . | |
| 3,690,255 | 9/1972 | Vass et al. | 89/7 |

FOREIGN PATENT DOCUMENTS

| | | | |
|---|---|---|---|
| 721289 | 6/1942 | Fed. Rep. of Germany | 102/443 |
| 51021 | 12/1939 | France . | |
| 891426 | 3/1944 | France . | |
| 204306 | 2/1924 | United Kingdom | 102/511 |
| 443059 | 2/1936 | United Kingdom . | |
| 574049 | 12/1945 | United Kingdom . | |
| 1170180 | 12/1967 | United Kingdom . | |
| 1262527 | 2/1972 | United Kingdom . | |
| 2061148 | 5/1981 | United Kingdom . | |

*Primary Examiner*—Harold J. Tudor

*Attorney, Agent, or Firm*—Cushman, Darby & Cushman

[57] ABSTRACT

A projectile suitable for firing from a gun barrel contains an additive which is dispensed along the gun barrel by the pressure of a gas propellant so as to reduce barrel wear. A charge of additive (11) is stored within a cylindrical recess in the rear face (12) of the projectile. In use, the pressure of the gas propellant acts on a nylon piston (6) slidably located within the tube (2), which piston in turn pressurizes the charge (11) forcing it forward through the four extrusion ports (9) to the exterior of the projectile. The charge additive (11) is preferably a mixture of a thermal insulator and a lubricant, best characterized by silicone oil or a paste mixture of titanium dioxide and silicone grease. The invention is particularly applicable to small arms bullets for firing from a rifled gun barrel, and may be incorporated in existing hollowed bullets, for example tracer bullets.

8 Claims, 4 Drawing Figures

WEAR REDUCING PROJECTILE

TECHNICAL FIELD

This invention relates to a projectile suitable for firing from a gun barrel and having means for dispensing an additive to the barrel to reduce barrel wear, herein referred to as a wear reducing projectile. In particular, but not exclusively, the projectile maybe a small arms bullet for firing from a rifled gun barrel.

BACKGROUND ART

Wear reducing rounds having gun barrel additive dispensing means embodied in either the projectile or its associated cartridge which do not substantially interfere with the desired firing mode of the gun into which the round is placed are known. On firing the round an additive is deposited along the barrel to reduce barrel wear by virtue of the additive's lubricating or thermal insulating properties.

The rate of application of a gun barrel wear reducing additive into a gun barrel ideally corresponds to wear severity along the barrel. Wear severity within a rifled gun barrel is typically at its worst in the region of the barrel bore close to the chamber of the gun where rifling commences, in which region the projectile experiences maximum rotational acceleration as it travels along the barrel. Thereafter, wear severity decreases as the projectile approaches the muzzle. The profile of wear severity along the barrel tends to be similar to that of the pressure of the propellant gas behind the projectile as the projectile is accelerated along the barrel.

An additive dispensing means embodied in the cartridge has the disadvantage that the inclusion of additive reduces the volume available for propellant: this is particularly disadvantageous in small arms rounds where the available propellant volume is small.

Additive dispensing means included in the projectile have hitherto relied upon inertial forces to release the additive from a store within the bullet as, for example, in the self-lubricating projectile described in UK Pat. No. 204,306. Such an additive dispensing means has the disadvantage that the additive is concentrated in the region where the projectile experiences maximum acceleration along the gun barrel which is typically one third the way along the barrel.

DISCLOSURE OF INVENTION

It is an object of the present invention to provide a wear reducing projectile having an additive dispensing means capable of providing a dispersion of additive more appropriate to wear severity distribution along the gun barrel.

According to the present invention there is provided a wear reducing projectile having a propellant opposable rear face transverse to a fore and aft axis characterised in

- that there is a recess within the rear face containing a charge of gun barrel additive,
- that there is a piston slidably located within the recess having a forward face adjacent the charge and a propellant opposable rear face, and
- that there is at least one additive extrusion port extending between the recess and the exterior of the projectile.

Preferably the recess is cylindrical and is in axial alignment with the fore and aft axis.

The gun barrel additive is preferably both a thermal insulator and a lubricant. The additive may be in a variety of forms ranging from various powder and grease combinations to liquids, but is preferably either a paste mixture of titanium dioxide and silicone grease, or a silicone oil which may be contained conveniently within a rupturable capsule.

The number of additive extrusion ports is preferably four, and the ports may either extend to the exterior of the projectile forward of its rear face, or may extend to the rear rearwardly through the piston.

BRIEF DESCRIPTION OF THE DRAWINGS

Embodiments of the present invention will now be described by way of example only with reference to the accompanying drawings, of which

MODES OF CARRYING OUT THE INVENTION

Figure 1:
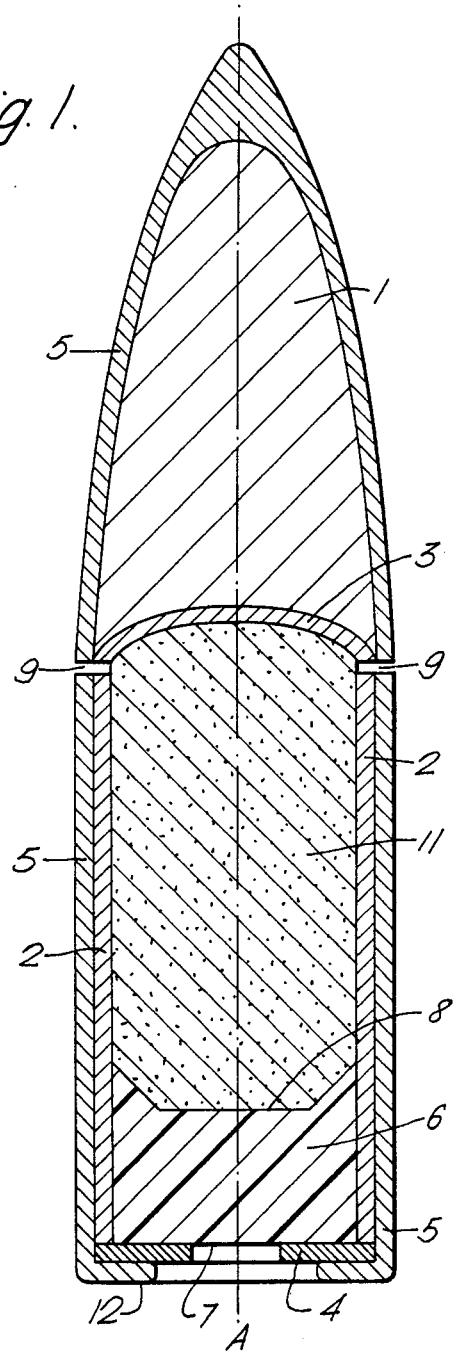
FIG. 1 is an axial section of a wear reducing small arms bullet fully charged with a gun barrel additive paste extrudable to the exterior the bullet forward of its propellant opposable rear face and contained within a rigid recess.

The wear reducing small arms bullet with a fore and aft axis A as shown in FIG. 1 has a soft lead bullet core 1 disposed in axial alignment with a rearward hard metal cylindrical tube 2 having a closed convex head 3 in intimate contact with the core 1. Rearward of the open end of the tube 2 is coaxially located a washer 4 the external diameter of which is identical to that of the tube 2. Both the core 1 and the tube 2 have an external metal cladding 5 which is turned over onto the rear face of the washer 4 to hold the assembled interior of the bullet in place and to form a propellant opposable rear face 12 within which is a rigid recess defined by the interior of the tube 2.

Against the forward face of the washer 4 and slidably located within the tube 2 rests a nylon piston 6 having a planar propellant opposable rear face 7 and a concave forward face 8. At regular space intervals around the tube 2 adjacent the head 3 are located four additive extrusion ports (9) extending radially between the recess and the exterior of the bullet.

The remaining internal volume of the tube 2 bounded by the head 3 and forward face 8 of the piston is charged with a gun barrel additive paste 11. The paste 11 comprises a mixture of titanium dioxide powder and silicone grease having a viscosity sufficient to prevent leakage through the ports 9 under normal rough handling conditions of the bullet before firing.

Gaseous propellant generated by the ignition of a propellant charge (not shown) acting on the rear faces 7 and 12 to accelerate the bullet along a gun barrel (not shown) produces a much higher pressure force on the rear face 7 than on the forward face 8 of the piston.

The design parameters of the wear reducing small arms bullet as described of such that the forward acting force on the rear face 7 per unit mass of the combined piston 6 and paste 11 portion of the bullet is substantially greater than the forward acting force on the rear face 12 per unit mass of the remainder of the bullet, thus causing the piston 6 and paste 11 to be forced forward within the accelerating bullet. The paste 11 confined within the interior of the tube 2 is thus compressed by the pressure of the propellant gas transmitted through the piston 6, such that the pressure of the paste 11 is significantly greater than that present at the exterior of the bullet adjacent the ports 9. The compression thus causes the paste 11 to extrude through the ports 9 to the exterior of the bullet. The rate of extrusion of the paste 11 through the ports 9 at any given point along gun barrel is thus substantially dependant upon the magnitude of the pressure of the propellant gas behind the bullet, and thus corresponds to wear severity distribution along the gun barrel.

The released paste 11 coats the exterior of the bullet and is partially transferred to the bore of the gun barrel (not shown) due to the close proximity of the moving bullet to the gun barrel. A rifled gun barrel designed to impart longitudinal axial twist to the bullet in motion is particularly advantageous in encouraging a more even transfer of paste 11 over the bore of the gun barrel. The paste 11 acts both to lubricate the frictional contact between the bullet and the gun barrel bore and to leave behind a coating of low thermal conductivity to reduce the transfer of heat from the hot prepellant gases to the gas barrel.

Figure 2:
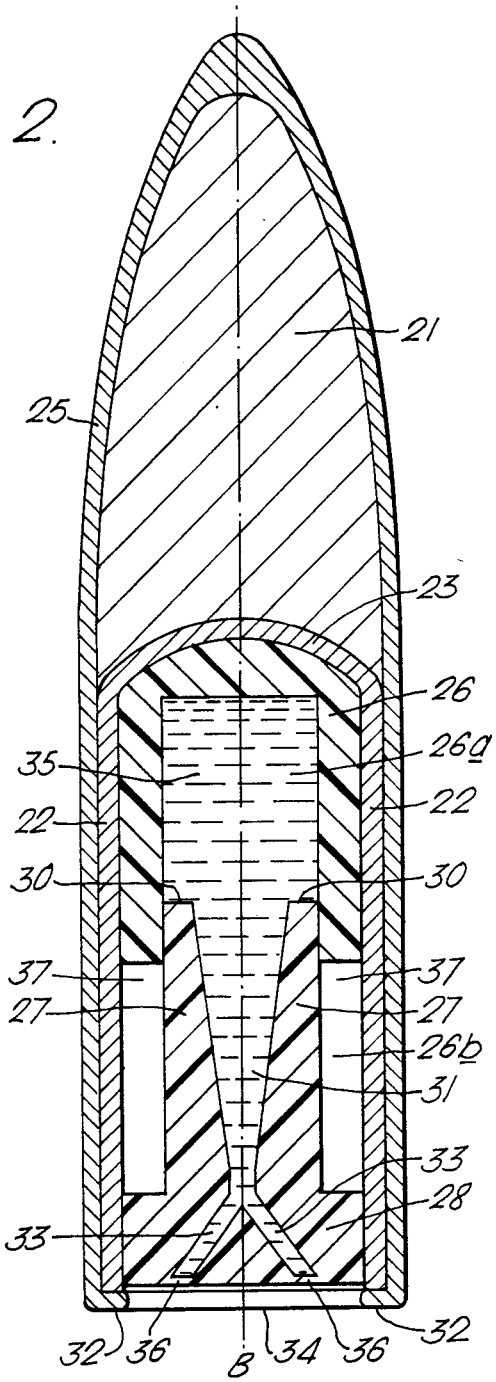
FIG. 2 is an axial section of a wear reducing small arms bullet fully charged with a gun barrel additive liquid rearwardly extrudable to the exterior of the bullet through a piston.

A second embodiment of the present invention is illustrated in FIG. 2 in which a wear reducing small arms bullet with a fore and aft axis B has a soft lead bullet core 21 in axial alignment with a rearward hard metal cylindrical tube 22 having a closed convex head 23 in intimate contact with the core 21. Both the core 21 and the tube 22 have an external metal cladding 25 which is turned over onto the rear end of the tube 22 to hold the assembled interior of the bullet in place, and to form a propellant opposable rear face 32 within which is a rigid recess defined by the interior of the tube 22.

A cylindrical nylon pot 26 open to the rear face 32 is tightly fitted in axial alignment with the tube 22 in intimate contact with the head 23. The longitudinal length of the pot 26 is slightly less than half that of the tube 22, and the internal diameter of the interior of the pot 26 is approximately 80% of that of the diameter of the interior of the tube 22. The interior of the pot 26 forms a forward chamber **26*a* which communicates with a rear chamber 26*b* being that part of the recess defined by the interior of the tube 22 rearward of the forward chamber 26*a*. Between the pot 26 and the rear face 32 is interposed a forward cylindrical nylon piston 27 attached to a rearward cylindrical nylon piston 28, each of which pistons is in axial alignment with the tube 22 and which are together slidable within the tube 22 and the pot 26. Within the forward face 30 of the forward piston 27 is coaxially located a tapered recess 31 which tunnels rearwardly into 4 substantially linear additive extrusion ports 33, each of which ports 33 angle rearwardly away from the fore and aft axis B to the rear face 34 of the rearward nylon piston 28**.

The interior of the pot 26, the tapered recess 31, and the ports 33 are all charged with a gun barrel additive liquid 35 of silicone oil sealed within the bullet by a thin nylon membrane 36 over each of the ports 33 at the piston rear face 34. The piston forward face 30 is located just within the interior of the pot 26, and thus an annular gas filled space 37 between the forward piston 27 and the tube 22 is isolated from the additive liquid 35.

As the bullet is fired down a gun barrel (not shown), a pressure force acting against the rear faces 32 and 34 causing bullet acceleration is transmitted through the pistons 28 and 27 to the piston forward face 30. The surface area of the rear face 34 is substantially greater than that of the forward face 30, and that the pressure force transmitted produces a higher pressure at forward face 30 than at the rear face 34 which higher pressure is transmitted throughout the substantially incompressible additive liquid 35 within the bullet. The initial pressure difference between that of the rear of the bullet and that of the additive 35 is sufficient to burst the membrane 36 and drive the liquid 35 from the interior of the pot 26 through the tapered recess 31 and the ports 33 out of the piston rear face 34 adjacent the rear face 32. The displacement of the liquid 35 from the bullet interior allows the pistons 27 and 28 to advance the rate moderated by the reaction forces of the viscous drag of the liquid 35, and of friction between the pistons 27 and 28 against the tube 22 and pot 26 interiors. The acceleration of the bullet within the gun barrel ensures that a substantial portion of the liquid ejected from the piston rear face 34 escapes the rear face 32 of the bullet. A gun barrel which is rifled assists in the distribution of liquid 35 in that the axial spin of the bullet ensures that a substantial portion of the liquid 35 ejected through the ports 33 angled away from the fore and aft axis B is thereby ejected outward onto the rifled bore of the gun barrel (not shown) to the rear of the bullet. The pistons 27 and 28 move through the interior of the tube 22 until the gas within the space 37 is compressed to approximately the pressure at the rear of the bullet, at which point the pistons 27 and 28 are brought to rest and no further extrusion takes place. The liquid 35 thus dispensed acts to reduce wear within the gun barrel in a similar manner to the paste 11 described in the embodiment of the invention illustrated in FIG. 1.

Figure 3:
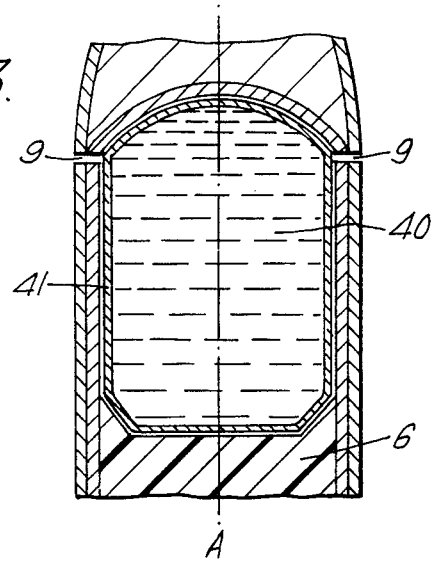
FIG. 3 is an axial section of a wear reducing small arms bullet having a gun barrel additive liquid contained and sealed within a rupturable capsule.

An alternative arrangement of the embodiment illustrated in FIG. 1 is illustrated in FIG. 3, in which the paste 11 stored within the bullet is replaced by a charge 40 of liquid silicone oil contained and sealed within a rupturable capsule 41. Under normal rough handling conditions of the bullet before firing the capsule 41 remains intact to prevent leakage of the charge 40, but the capsule 41 readily bursts open to release its contents on application of gas propellant pressure to the rear of the piston 6. After the capsule 41 has burst, the charge 40 is forced out to the exterior of the bullet through the ports 9 by the piston 6.

Figure 4:
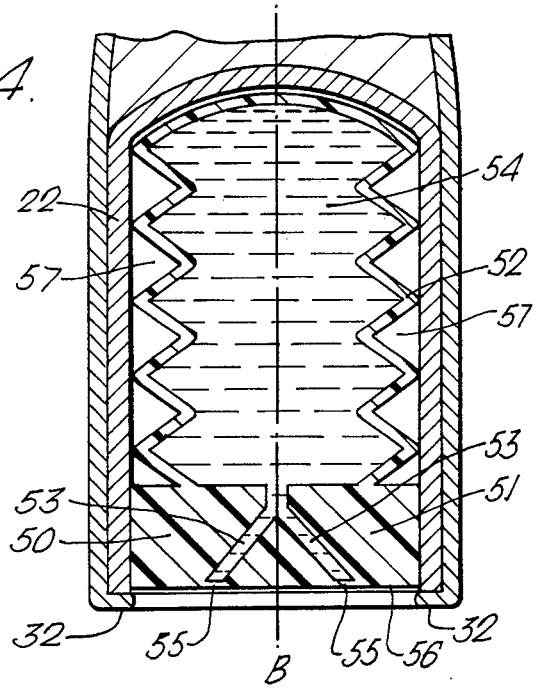
FIG. 4 is an axial section of a wear reducing small arms bullet having a gun barrel additive contained within a collapsible bellows.

An alternative arrangement of embodiment of the present invention illustrated in FIG. 2 is illustrated in FIG. 4, in which the pot 26 and pistons 27 and 28 are replaced by a single additive extruder 50. The extruder 50 comprises a rearward nylon cylindrical piston 51 sealing the interior of the tube 22 from propellant opposable rear face 32, which piston 51 is attached to a forward hollow cylindrical bellows 52 in axial alignment with both the tube 22 and the piston 51. The bellows 52 is collapsible along the fore and aft axis B.

The interior of the bellows 52 is connected to the exterior of the bullet by four linear extrusion ports 53 through the piston 51 angled rearwardly away from the axis B. The interior of the bellows 52 is filled with a charge 54 of silicone oil sealed within the bullet by a nylon membrane 55 over each of the ports 53 at a rear face 56 of the piston 51.

The action of firing the bullet through a gun barrel causes the charge 54 to extrude to the exterior of the bullet in a similar manner to that described in the embodiment of the invention illustrated in FIG. 2. The function of the piston 27 slidable within the pot 26 illustrated in FIG. 2 is performed by the bellows 52 illustrated in FIG. 4. As the piston 51 is driven forward by the pressure to the rear of the bullet, a higher pressure is produced within the bellows 52 because the average sectional area of the bellows 52 interior transverse to the axis B is less than the surface area of the piston rear face 56. The piston 51 thus moves forward displacing liquid which is ejected from the piston rear face 56 in much the same way as is described in the embodiment of the present invention illustrated in FIG. 2, until the pressure of gas in space 57 between the tube 22 and the bellows 52 increases until substantially equal to that of the rear of the bullet.

I claim:

1. A wear-reducing projectile, comprising:

a propellant-opposable rear wall transverse to a lengthwise axis of said projectile;

a recess within said rear wall containing a charge of gun barrel wear-reducing additive;

a piston slidably located within said recess and having a forward face adjacent said charge and having a propellant opposable rear face; and at least one additive extrusion port extending rearwardly through said piston from said recess to the exterior of the projectile; wherein firing of said projectile causes said piston to be accelerated toward said charge and force said charge from the projectile through said at least one extrusion port with a degree substantially in accordance with the wear-severity distribution of an associated gun barrel.

2. A projectile as in claim 1, wherein:

said recess comprises a forward cylindrical chamber communicating with a rearward cylindrical chamber, each chamber being in axial alignment with said lengthwise axis, and said forward chamber having a diameter less than that of said rearward chamber.

3. A projectile as in claim 2, wherein;

said forward chamber has a diameter of between 60% and 80% of that of said rearward chamber.

4. A projectile as in claim 3, wherein:

said charge is contained within said forward chamber, and said piston comprises a forward piston slidably located within the forward chamber and a rearward piston rigidly attached to the forward piston and slidably located within the rearward chamber.

5. A projectile as in claim 1, wherein:

said charge is additionally contained in a hollow and collapsible cylindrical bellows in axial alignment with, and disposed within, said recess, with a forward and a rearward end each substantially transverse said lengthwise axis.

6. A projectile as in claim 1, comprising:

a plurality of said additive extrusion ports symmetrically disposed about said legnthwise axis and angled outwardly thereform.

7. A projectile as in claim 6, wherein:

said gun barrel wear-reducing additive is a liquid sealed within the projectile by a rupturable membrane covering each of said additive extrusion ports.

8. A projectile as in claim 5, wherein said forward face of said piston comprises said rearward end of said bellows.

* * * * *